United States Patent [19]

Walker

[11] 4,358,487

[45] Nov. 9, 1982

[54] INFLATABLE ORNAMENT

[75] Inventor: S. David Walker, Overland Park, Kans.

[73] Assignee: Satellite Balloon Manufacturing Co., Lenexa, Kans.

[21] Appl. No.: 255,135

[22] Filed: Apr. 17, 1981

[51] Int. Cl.[3] ..... A47G 33/08

[52] U.S. Cl. ..... 428/11; 46/87; 244/31; 428/12; 428/181

[58] Field of Search ..... 428/9, 11, 12, 181; 46/87; 244/31

[56] References Cited

U.S. PATENT DOCUMENTS

| | | | |
|---|---|---|---|
| D. 161,734 | 1/1951 | Burkes | D21/179 X |
| 1,274,174 | 7/1918 | Lee | 428/11 X |
| 3,230,663 | 1/1966 | Shabram | 428/16 X |
| 3,802,946 | 4/1974 | Chase | 428/11 |
| 3,835,308 | 9/1974 | Reese | 428/16 X |
| 3,900,638 | 8/1975 | Du Bato | 428/11 |
| 4,077,588 | 3/1978 | Hurst | 428/16 X |
| 4,226,902 | 10/1980 | Webb | 428/7 |

*Primary Examiner*—Henry F. Epstein

*Attorney, Agent, or Firm*—Krass, Young & Schivley

[57] ABSTRACT

An inflatable ornament suitable for hanging on a Christmas tree limb or the like is formed from a pair of flexible plastic sheets joined along their periphery to define a collapsible, substantially fluid-tight envelope. The envelope includes a reduced neck portion having a valve therein for filling the ornament with a suitable fluid such as air. The valve comprises a stem extending laterally outward from one of the sheets and a removable plug for sealing the stem. A hook member connected to the stem, or formed integral with the plug, is adapted to suspend the ornament from the limb. A reflective metal coating applied to the envelope gives the appearance of a glass ornament.

21 Claims, 9 Drawing Figures

Fig-1
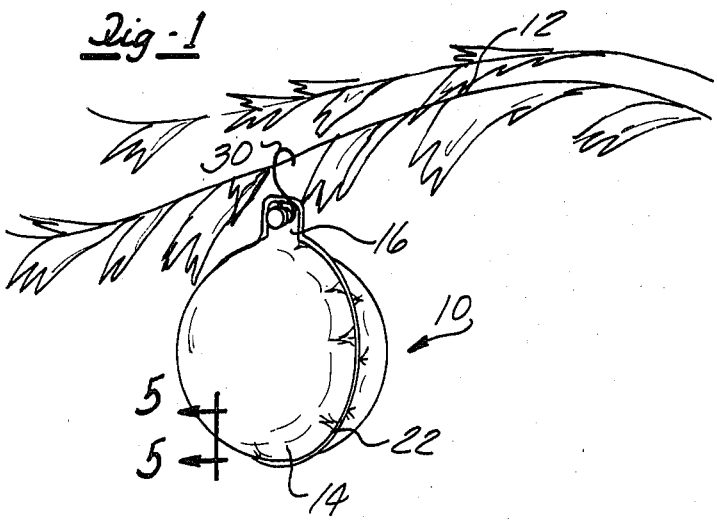
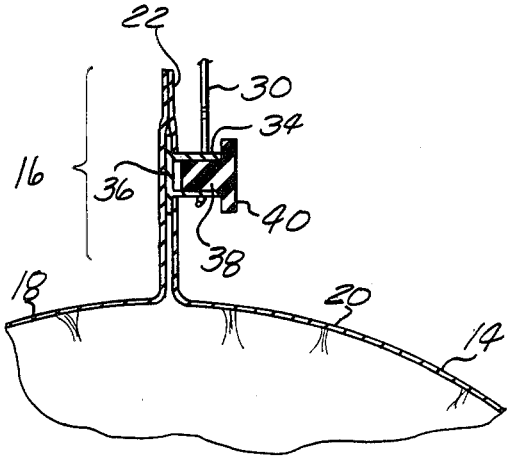
Fig-2
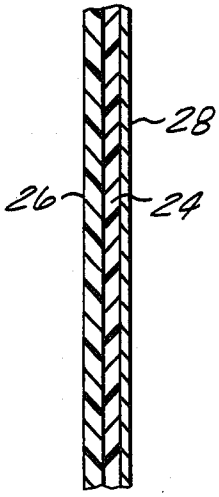
Fig-5

Fig-3
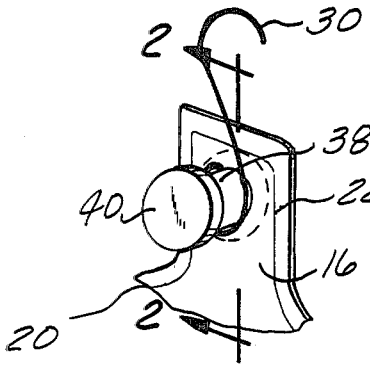
Fig-4
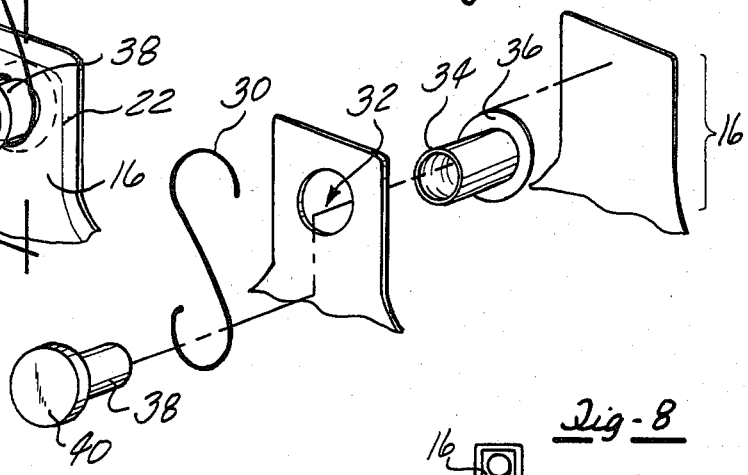
Fig-8
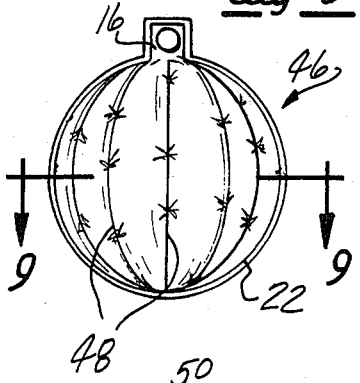
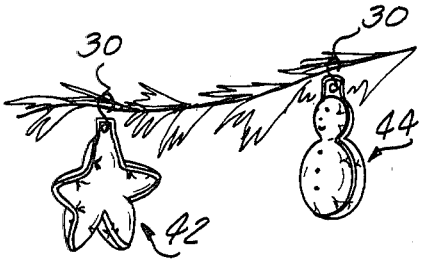
Fig-6
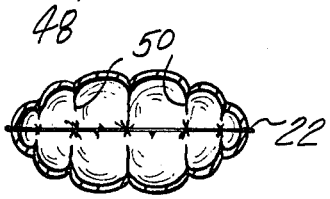
Fig-9
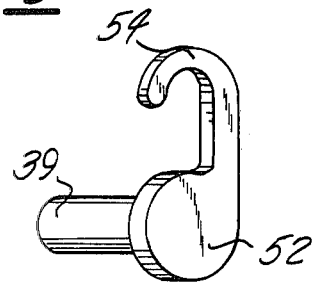
Fig-7

INFLATABLE ORNAMENT

TECHNICAL FIELD

The present invention generally relates to ornaments of the type employed to decorate a Christmas tree or the like, and deals more particularly with a substantially unbreakable, inflatable ornament construction.

BACKGROUND ART

Decorative ornaments adapted to be hung from Christmas tree limbs or the like have traditionally been manufactured from delicate glass or other frangible materials. The body of such ornaments is typically of a one-piece construction and is provided with a suitable hook for suspending the ornament from a tree limb.

Prior art ornaments of the type described above are extremely subject to breakage due to their delicate nature. Breakage commonly occurs during both handling and storage of the ornaments and poses a definite health hazard, particularly where small children may gain access to sharp splinters and pieces of a broken ornament.

Another shortcoming of prior art glass-type ornaments relates to the fact that such ornaments displace a substantial amount of volume during storage thereof. Moreover, these ornaments must be delicately packed and isolated from each other during storage due to their fragile nature.

In addition to the deficiencies mentioned above, several limitations exist with regard to the geometric shapes and designs which may be achieved using blown glass constructions. For example, it is virtually impossible to achieve sharply defined corners or lines in a broken glass ornament. Additionally, glass ornaments are subject to breakage by processes for applying graphic designs or indicia thereon such as silk screening techniques or the like.

Accordingly, it is an important object of the present invention to provide an ornament which overcomes each of the deficiencies mentioned above, including the problem of breakage.

Another object of the invention is to provide an inflatable ornament which may be collapsed for storage purposes, thereby minimizing the volume of space required to store a multiplicity of such ornaments.

It is still a further object of the invention to provide an ornament of the type described above which may be easily formed from two sheets of flexible material, each suitable for receiving printed indicia or graphic designs thereon.

A still further object of the invention is to provide an inflatable ornament as described above which includes means formed integral with the ornament for hanging the ornament on a support, such as a Christmas tree limb.

These and further objects of the invention will be made clear or will become apparent in the course of the following description.

DISCLOSURE OF THE INVENTION

An inflatable ornament suitable for hanging on a Christmas tree limb is formed from a pair of flexible plastic sheets joined along their periphery to define a collapsible, fluid-tight envelope. Each of the sheets may be provided with a coating of heat actuatable material on the interior face thereof to allow joining of the sheets by heat sealing techniques. The envelope includes a reduced neck portion having a valve therein for filling the ornament with a suitable fluid such as air. The valve comprises a tubular stem extending laterally outward from one of the sheets and a removable plug for sealing the stem. A hook member connected with the stem or formed integral with the plug is adapted to suspend the ornament from the limb. A vapor deposited, reflective metal coating is applied to the exterior face of the envelope and gives the appearance of a glass ornament. Pleats and other sharp lines of definitions may be produced on the ornament by folding and heat sealing portions of the sheets.

BRIEF DESCRIPTION OF THE DRAWINGS

In the drawings, which form an integral part of the specification and are to be read in conjunction therewith, and in which like components are designated by identical reference numerals in the various views:

FIG. 1 is a perspective view of an inflatable ornament forming the preferred embodiment of the present invention, depicted in suspended relationship to a tree limb;

FIG. 2 is a sectional view taken along the line 2—2 in FIG. 3;

FIG. 3 is a fragmentary, perspective view of the neck portion of the ornament shown in FIG. 1;

FIG. 4 is an exploded view of the neck portion shown in FIG. 3;

FIG. 5 is a sectional view taken along the line 5—5 in FIG. 1;

FIG. 6 is a perspective view of alternate shapes of the ornament shown in FIG. 1;

FIG. 7 is a perspective view of an alternate form of the plug and suspension hook;

FIG. 8 is an elevational view of an alternate form of inflatable ornament; and, FIG. 9 is a sectional view taken along the line 9—9 in FIG. 8.

BEST MODE FOR CARRYING OUT THE INVENTION

Referring first to FIGS. 1–5, the present invention is generally concerned with an inflatable, decorative ornament generally indicated by the numeral 10 which is adapted to be suspended from a support, such as a Christmas tree limb 12 or the like. Ornament 10 comprises a pair of flexible plastic film sheets 18 and 20, respectively, continuously joined along their periphery by a seam 22 to define a fluid inflatable envelope 14. As will be discussed later, the geometrical shape of the ornament 10 is essentially determined by the peripheral geometry of the sheets 18 and 20. Each of the sheets 18 and 20 preferably comprises a composite material which includes a layer 24 of non-elastomeric polymer material such as nylon. However, layer 24 may consist of other materials such as polyethylene, polypropylene, polyester, polyvinyl chloride, cellophane and the like. The interior surfaces of layer 24 may be coated with a suitable adhesive 26 in order to produce the seam 22. The adhesive coating 26 may be produced by heat sealing; however, the seam 22 may also be produced by other techniques such as adhesive bonding, solvent sealing, extruded bead sealing or hot melt sealing. In any event, the seam 22 extends around the entire periphery of the sheets 18 and 20 to form a continuous substantially fluid-tight seal between the sheets 18 and 20. A relatively thin coating 28 of reflective metal is applied to the exterior face of layer 24; reflective coating 28 may consist of a thinly rolled film of any well known metal or alloy, or may be applied to layer 24 by conventional vapor deposition techniques.

The envelope 14 includes a reduced neck portion 16 along the seam 22. Sheet 20 is provided with a circular opening 32 for receiving a valve assembly through which a fluid may be introduced in order to inflate or deflate the ornament 10. The valve assembly includes a tubular stem 34 extending through the opening 32 and a plug 38 adapted to be frictionally received within the outer end of stem 34. Stem 34 includes an annular shoulder 36 on the inner end thereof which is secured, as with adhesive, to the inner face of sheet 20 immediately surrounding the opening 32. Plug 38 is provided with a circularly-shaped flange 40 on the outer end thereof which is greater in diameter than the outside diameter of stem 34.

Means for suspending the ornament 10 from a support such as limb 12 includes an S-shaped hook member 30 having a pair of loops at the opposite extremities thereof. One looped extremity of member 30 is trained around the exterior surface portions of stem 34 and is prevented from sliding off the end of stem 34 by the flange 40. The opposite looped extremity of hook member 30 is adapted to be hooked around limb 12.

As best seen in FIG. 2, the sheets 18 and 20 at neck portion 16 are disposed in close face-to-face opposition, with the interior face of sheet 18 engaging shoulder 36 and covering the opening defined in the inner end of stem 34. In order to inflate the ornament 10, the plug 38 is removed from the stem 34 and a suitable fluid, such as air, is introduced through the valve stem 34 into the interior of the envelope 14. As fluid is introduced into the envelope 14, that portion of the sheet 18 overlying the stem 34 flexes away from the shoulder 36 to permit free flow of the incoming fluid. After the envelope 14 has been inflated to the desired level, pressure may be applied to the exterior face of sheet 18 overlying stem 34 in order to close off the interior opening in stem 34 to prevent immediate escape of fluid; the plug 38 is then inserted into the stem 34 in order to close the valve and prevent fluid escape.

In order to deflate the ornament 10 for storage purposes or the like, plug 38 is removed and the envelope 14 may be squeezed slightly; additional fluid pressure created by squeezing the envelope 14 forces the sheets 18 and 20 apart at neck portion 16 such that fluid flows outwardly through neck portion 16 and valve stem 34. Essentially the entire volume of fluid may be exhausted in this manner from the envelope 14 such that the ornament 10 assumes an essentially flat configuration. The flattened ornament 10 may then be folded or rolled if desired for storage purposes. Alternatively, a number of the flattened ornaments 10 may be stacked on top of each other within a relatively small volume of space for shipping or storage.

Referring now to FIG. 7, the need for a separate hook member 30 may be eliminated by employing a specially configured plug 39 which is provided with a hook element 54 formed integral with flange 52.

As previously mentioned, the basic profile of the ornament 10 is largely determined by the outline of the envelope 14. Consequently, various geometric shapes such as a star 42 and snowman 44 shown in FIG. 6 may be produced by simply cutting the sheets 18 and 20 to the desired shape. The use of sheets 18 and 20 present other numerous possibilities for altering the shape of the ornament 10. For example, as shown in FIGS. 8 and 9, a ribbed effect may be accomplished by folding portions of each of the sheets 18 and 20 onto themselves and heat sealing such portions to form pleats 50. Pleats 50, disposed on the interior of envelope 14, define circumferentially extending, recessed lines 48 in the ornament 46 which provides a pleasing exterior surface contour.

It may be appreciated that various types of graphical designs or indicia may be printed on the exterior surface areas of each of the sheets 18 and 20 before the ornament 10 is inflated, and in fact before the sheets 18 and 20 are joined together. Such printing may be carried out using conventional printing apparatus in large quantities at relatively low cost.

Industrial Applicability

From the foregoing, it may be appreciated that the inflatable ornament described above not only provides for the reliable accomplishment of the objects of the invention, but does so in a particularly simple and cost defective manner. Although the ornament has been described with reference to its use as a Christmas tree ornament, it may be appreciated that such ornament may be employed for various other applications including advertising or the like. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A decorative ornament adapted to be suspended from a support, comprising:

a pair of flexible plastic sheets continuously joined together along their entire periphery to define a fluid inflatable envelope, said envelope having an opening therein;

valve means adjacent said periphery and communicating with said opening for selectively directing fluid through said opening into the interior of said envelope to inflate said envelope, said valve means being secured to one of said sheets adjacent the top of said envelope and including at least a portion thereof extending laterally outward from said one sheet to define a generally horizontal protection on said envelope; and, means connecting said portion of said valve means with said support for suspending said envelope from said support.

2. The ornament of claim 1, wherein each of said sheets includes a layer of non-elastomeric material having a reflective metallic coating on the exterior face thereof.

3. The ornament of claim 1, wherein each of said sheets includes a layer of heat activatable adhesive on the interior face thereof, said sheets being heat sealed around the peripheries thereof.

4. The ornament of claim 1, wherein said portion of said valve means includes a tubular stem extending through said opening and means removably installed on said stem for sealing one end of said stem.

5. The ornament of claim 4, wherein said envelope includes a reduced neck portion adjacent said periphery and said opening is defined in one of said sheets within said neck portion.

6. The ornament of claim 1, wherein said valve means includes a shoulder on one end of said stem and secured to the interior face of said one sheet.

7. The ornament of claim 1, wherein said suspending means includes a hook member removably connected to said stem.

8. The ornament of claim 1, wherein said hook member is generally S-shaped.

9. The ornament of claim 1, wherein said suspending means is formed integral with said sealing means.

10. The ornament of claim 9, wherein said suspending means includes a plug member having a shoulder portion engaging the outer end of said stem and said suspending means includes a hook portion on said shoulder portion adapted to hang on said support.

11. A collapsible ornament adapted to be inflated with gas and hung from a tree limb or the like, comprising:

a flexible, gas inflatable envelope defined by a pair of sheets joined together, said envelope having a reduced neck portion in upper regions thereof and an opening in said neck portion through which gas may be introduced into the interior of said envelope for inflating said envelope, said neck portion being defined adjacent the periphery of said sheets;

a reflective coating of metal on at least one side of the exterior surface of said envelope;

valve means on said neck portion for closing said opening, including a lateral projection on one of said sheets extending generally horizontally outward from said neck portion; and, means secured on said lateral projection for hanging said envelope on said limb.

12. The ornament of claim 11, wherein said opening is defined in one of said sheets and said lateral projection includes an elongate valve communicating with said opening.

13. The ornament of claim 11, wherein said sheets comprise non-elastomeric plastic and are joined together around their periphery.

14. The ornament of claim 13, wherein:

said lateral projection including a tubular stem having one extremity communicating with said opening and secured to the interior face of said one sheet, and said closing means further includes a plug member removably disposed within the opposite extremity of said stem.

15. The ornament of claim 1, wherein said hanging means is connected to said stem.

16. The ornament of claim 1, wherein said hanging means is formed integral with said plug member.

17. The ornament of claim 1, wherein at least one of said sheets includes at least one pleat therein.

18. A decorative ornament suitable for decorating a Christmas tree or the like and which may be gas inflated from a collapsed condition to an inflated condition, comprising:

a pair of flexible sheets joined along their mutual peripheries to define a gas tight envelope, said sheets being substantially in face-to-face contact and parallel to each other when said ornament is in said collapsed condition thereof, said envelope including an opening therein through which gas may be introduced to inflate said envelope; and valve means on said envelope adjacent the top thereof for directing said gas through said opening and for selectively closing said opening to maintain said ornament in said inflated condition thereof, said valve means extending laterally, generally horizontally outward from said envelope.

19. The ornament of claim 18, wherein said valve means is elongate and is secured to the interior face of one of said sheets.

20. The ornament of claim 18, wherein said envelope includes a reduced neck portion integral with said sheets, said neck portion being disposed along said mutual peripheries and having said valve means mounted thereon.

21. The ornament of claim 18, wherein portions of said sheets adjacent said top of said envelope are disposed in closely spaced, essentially face-to-face relationship to each other, and said valve means is mounted on one of said sheets within said portions.

* * * * *

UNITED STATES PATENT AND TRADEMARK OFFICE

CERTIFICATE OF CORRECTION

PATENT NO. : 4,358,487
DATED : November 9, 1982
INVENTOR(S) : S. David Walker

It is certified that error appears in the above-identified patent and that said Letters Patent are hereby corrected as shown below:

Column 4, line 20 "defective" should be --effective--.

Column 4, line 48 "protection" should be --projection--.

Column 5, line 42 "including" should be --includes--.

Signed and Sealed this

*Nineteenth* Day of *April 1983*

[SEAL]

*Attest:*

GERALD J. MOSSINGHOFF

*Attesting Officer*

*Commissioner of Patents and Trademarks*